US012521616B2

(12) United States Patent
Slade

(10) Patent No.: US 12,521,616 B2
(45) Date of Patent: Jan. 13, 2026

(54) BOXING DUMMY GAME

(71) Applicant: Daniel Slade, San Francisco, CA (US)

(72) Inventor: Daniel Slade, San Francisco, CA (US)

( * ) Notice: Subject to any disclaimer, the term of this patent is extended or adjusted under 35 U.S.C. 154(b) by 129 days.

(21) Appl. No.: 18/384,303

(22) Filed: Oct. 26, 2023

(65) Prior Publication Data

US 2024/0139600 A1 May 2, 2024

Related U.S. Application Data

(60) Provisional application No. 63/420,199, filed on Oct. 28, 2022.

(51) Int. Cl.
*A63B 69/20* (2006.01)

(52) U.S. Cl.
CPC ..... *A63B 69/20* (2013.01)

(58) Field of Classification Search
CPC ..... A63B 69/20–34
See application file for complete search history.

(56) References Cited

U.S. PATENT DOCUMENTS 835,796 A * 11/1906 Lindsley ..... A63B 69/215 482/83
3,804,406 A * 4/1974 Viscione ..... A63B 69/215 482/4
4,088,315 A * 5/1978 Schemmel ..... G01G 19/52 482/84
5,613,925 A * 3/1997 Miasserian ..... A63B 69/22 482/86
6,152,863 A * 11/2000 Nelson ..... A63B 69/222 482/84
8,025,612 B1 * 9/2011 Buzzanco ..... A63B 69/24 482/90
8,079,938 B2 * 12/2011 Jones ..... A63B 69/32 482/84
8,348,815 B2 * 1/2013 Signorino ..... A63B 69/0053 482/84
8,777,818 B1 * 7/2014 Tate, Jr. ..... A63B 69/215 482/83
2011/0059827 A1 * 3/2011 Fazio ..... A63B 24/0075 482/83
2012/0065032 A1 * 3/2012 Jang ..... A63B 69/32 482/83

(Continued)

FOREIGN PATENT DOCUMENTS

CN 112156441 A * 1/2021 ..... A63B 69/004
CN 116059610 A * 5/2023

*Primary Examiner* — Nyca T Nguyen
(74) *Attorney, Agent, or Firm* — Lyman Moulton, Esq.; Moulton Patents, PLLC.

(57) ABSTRACT

The boxing dummy game allows users to engage with the current and former sports champions and specifically, boxing legends within an apparatus and a gaming app. Furthermore, a player boxer matches a remote player boxer through the boxing apparatus in a wireless communication with a remote boxing apparatus. Therefore, a match comprises the player boxer's hand speed vs. the remote player boxer's hand speed and the latter larger than the former indicated by a yell sound from the head speaker. Applications of the present disclosure include a boxing dummy represented by an icon and the attribute box and connections there between are virtual and matches are managed by a cell phone application and non-transient computer circuits.

20 Claims, 3 Drawing Sheets

(56) References Cited

U.S. PATENT DOCUMENTS

| | | | | |
|---|---|---|---|---|
| 2012/0108394 | A1* | 5/2012 | Jones | A63B 69/22<br>482/84 |
| 2015/0018174 | A1* | 1/2015 | Partlo | A63B 69/222<br>482/87 |
| 2018/0065016 | A1* | 3/2018 | Hall | A63B 69/222 |
| 2022/0280853 | A1* | 9/2022 | Wilson | A63B 69/34 |

* cited by examiner

BOXING DUMMY GAME

CROSS REFERENCE

The present Non-Provisional patent application claims priority and reference to the pending Provisional patent application, 'Boxing Game,' 63420199 by the Applicant Daniel Slade filed Oct. 28, 2022 expressly and implied in its entirety.

BACKGROUND

The viewing of professional competitions and leagues has been a favorite pastime for generations. However, there is a great deal of speculation among fans over whether a champion of present would triumph over a previous legend. There have been no products available as original equipment or as an aftermarket to address this market.

Boxing and MMA (mixed martial arts) training have become increasingly popular sports among individuals globally. The structure of modern training targets, however, have a great tendency of fracturing individual's joints and are unstable when users try emulating a real fight. The current targets used for this vigorous training frequently move, fall over and wing back and forth thus creating an unrealistic fight experience and leads to an inaccurate aim. There have been no products available as original equipment or as an aftermarket to address this problem.

An apparatus that lets a recent boxing champion compete against a champion from the past is not being met by any known device or system at present. There have been no products available as original equipment or as an aftermarket to address this problem either.

There exists a need for an apparatus that is not being met by any known or disclosed device or system of the present market for virtually fighting peers and past boxing legends.

SUMMARY OF THE INVENTION

The main purpose of the boxing game is to allow users to engage with the current and former sports champions and specifically, boxing legends within a gaming app. A mount supports springs to the boxing dummy. A frame is attached to the mount via the springs. The frame includes adjustable tracks for a height adjustment relative to the mount. The boxing dummy includes pads near a head and hands and optionally feet of the boxing dummy and is attached to the frame via the plates.

The boxing apparatus includes a boxing dummy with a head and shoulders and a speaker in the head and a left hand paddle and a right hand paddle each attached to the shoulders via a spring concentric to a rod with a variable penetration into the spring. The boxing apparatus also includes an attribute box configured to measure a player boxer attribute including a hand speed, a hand strength and a handedness and configured to electronically store, match and retrieve the hand speed, the hand strength and handedness. The boxing apparatus further includes a stepper motor in a mechanical connection with the rod and in an electrical connection with the attribute box and configured to cause the variable penetration based on the player boxer attribute.

Furthermore, a player boxer matches a remote player boxer through the boxing apparatus in a wireless communication with a remote boxing apparatus. Therefore, a match comprises the player boxer's hand speed vs. the remote player boxer's hand speed and the latter larger than the former indicated by a yell sound from the head speaker.

Similarly, a match comprises the player boxer's hand strength vs. the remote player boxer's hand strength and the former larger than the latter indicated by a yell sound from the remote head speaker.

Applications of the present disclosure include a boxing dummy represented by an icon and the attribute box and connections there between are virtual and matches are managed by a cell phone application and non-transient computer circuits.

Figure 1:
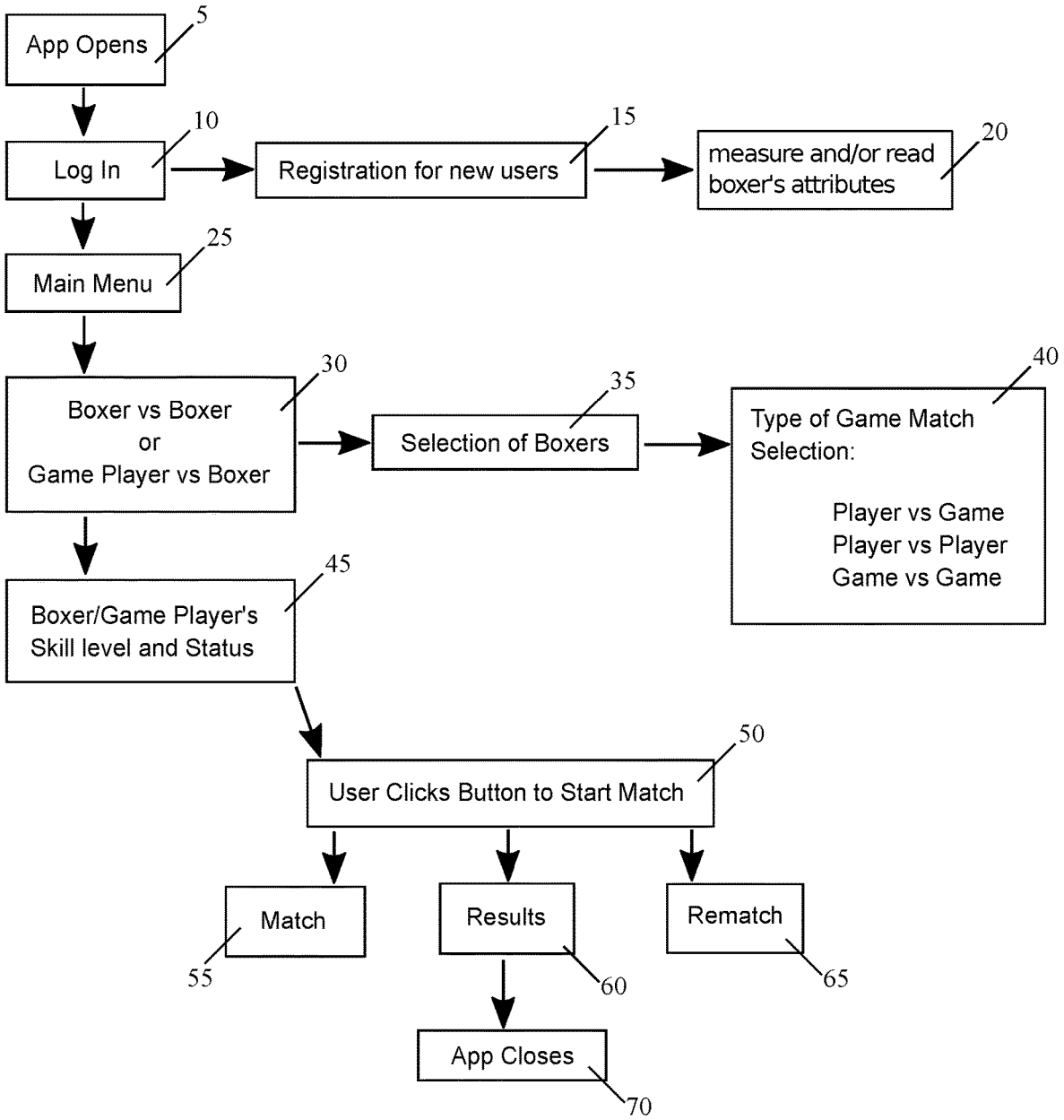
FIG. 1 is a flow chart of the boxing game in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIG. 1 is a flow chart of the boxing game in accordance with an embodiment of the present disclosure. The view includes app opens 5, log in 10, registration for new users 15, measure and/or record boxer's attributes 20, main menu 25, boxer vs boxer or game player vs boxer 30, selection of boxers 35, select type of game match 40 (player vs game, player vs player, game vs game), boxer/game player's skill level and status 45, user click button to start 50: match 55, results 60, or rematch 65, and app closes 70 in accordance with an embodiment of the present disclosure.

The present disclosed boxing game also known as the "Professional Boxing Time Machine" solves the dilemma of sports fans pondering whether current names of the boxing or sports world would be capable of defeating the names of previous generations, via a programmed experience. Expanding upon the technology used to rank players, the professional boxing time machine allows the user to not only compete with active eligible players in applicable sports leagues but also grants the user the option to compete against players of the past via a digital representation. The representation of the sporting professionals features a comprehensive portrayal of the player's body structure, accumulated personal statistics, physical capabilities and attributes, hand and foot speed and handedness (left or right), technique, etc.—all of which are based on accurate metrics/performances of the athlete—and that are customizable to the user within the platform. Designed to be compatible with iPhones and Android smartphones, the professional boxing time machine permits one to create an account and incorporate his or her imagery and talents into an avatar capable of battling against professional athletes in various sporting leagues.

Figure 2A:
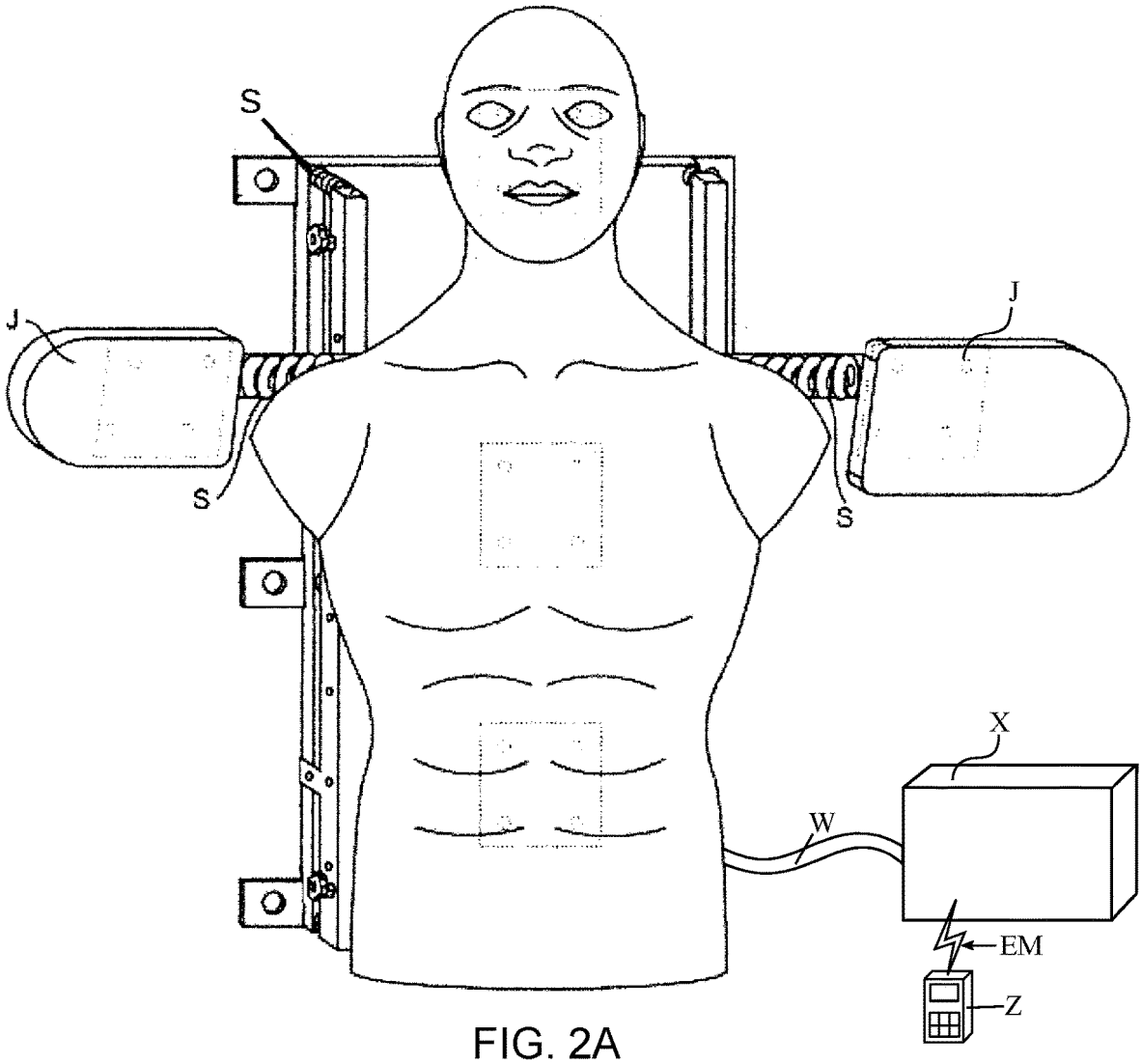
FIG. 2A is a front view of the assembled Boxing Dummy apparatus in accordance with an embodiment of the present disclosure.

FIG. 2A is a front perspective view of the Boxing Dummy apparatus in assembled parts in accordance with an embodiment of the present disclosure. The view shows boxing dummy D, left and right hand paddles J and springs S. The attribute box X is shown remote to the boxing dummy D but could also be tucked inside the boxing dummy D but is shown outside to avoid shock and impact from boxing blows to the boxing dummy D. The wire W can also be replace with wireless circuits in an embodiment. The EM electromagnetic wave enables communication between the attribute box X and the remote control Z. It is known that a person's response time can be measured electronically and accurately by successive pushes of a button, or in the case of the present disclosure by successive blows to a hand paddle on a boxing dummy. The response time is measured and recorded for a player boxer or for a remote virtual boxer and can also be entered posthumously for a professional boxer by evaluating videos and recordings of the professional boxer.

Figure 2B:
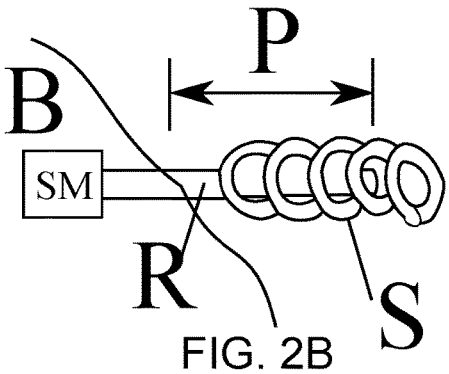
FIG. 2B is a close up view of the spring and the rod in accordance with an embodiment of the present disclosure.

FIG. 2B is a close up perspective view of the Spring and Rod assembly in accordance with an embodiment of the present disclosure. The spring S and the rod R assembly changes the spring response based on a penetration P of the rod coaxially into the spring by stiffening the spring response. A stiffer spring response is associated with a stronger arm in the limit when the spring doesn't flex at all since the rod R has penetrated the spring S completely. On the other had, a soft response in the limit when the rod has not yet penetrated the spring.

Figure 3:
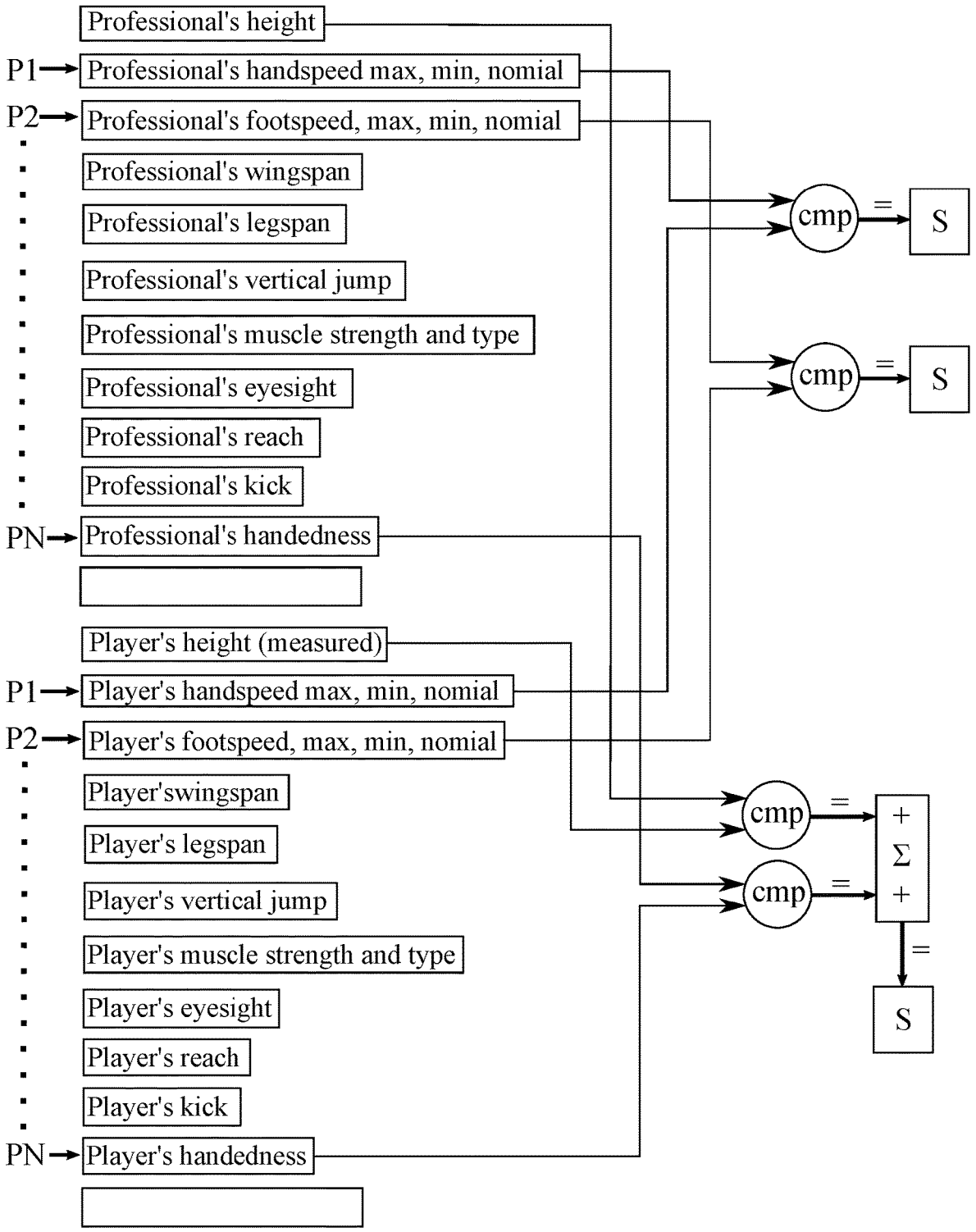
FIG. 3 is a depiction of attributes stored in the attribute box for determining matches in accordance with an embodiment of the present disclosure.

FIG. 3 is a depiction of attributes stored in the attribute box for determining matches in accordance with an embodiment of the present disclosure. The pointer P points to an attribute to be compared or matched between a virtual boxer or a professional boxer through stored attributes or through a remote boxing dummy game with a player boxer, ie someone playing the disclosed game. The CMP circles are compare circuits which determine which respective attribute is larger and in embodiments feed a summation circuit to determine an outcome of a match or a meet. In embodiments, the compare circuit directly drives a speaker in the boxing dummy to yell something victorious for winning the match. The S blocks are therefore speakers and the sigma+ block is a summation circuit. The handedness attribute is related to the player boxer or the virtual boxer being right handed or left handed. Studies have shown that left handedness is an advantage in sports where a boxer is right handed and opponents he has practiced with are also right handed because the boxer has a hard time anticipating an opponent who is left handed. Therefore, handedness that is not matched in an opponent gives the opponent an advantage. Player boxers simply can enter the handedness as a factor in the attributes box for a virtual player if they want to be realistic in a virtual or in a remote match. Embodiments of the disclosure include pointers P for one attribute at a time or for multiple attributes matched at the same time.

Furthermore, a player boxer matches a remote player boxer through the boxing apparatus in a wireless communication with a remote boxing apparatus. Therefore, a match comprises the player boxer's hand speed vs. the remote player boxer's hand speed and the latter larger than the former indicated by a yell sound from the head speaker. Similarly, a match comprises the player boxer's hand strength vs. the remote player boxer's hand strength and the former larger than the latter indicated by a yell sound from the remote head speaker.

The Boxing Dummy introduces a novel spring technology that creates a more lifelike boxing experience and therefore facilitates an accurate, intense striking response for the user. The boxing apparatus can be easily mounted on concrete, block, or stud walls and adjusted based on the user's height and reach offering options in height 6" up or down, based on a user. The boxing apparatus has tension springs welded within to mimic a real strike motion as these highly flexible springs ensure the target moves in the direction the user is striking, whether a punching or kicking action, while simultaneously absorbing joint stress as the spring compresses and springs back. The Spring Impact primary body target is strategically designed in half round cylinder shape to ensure users are able to perform full body strikes in a variety of angles while adjustment pins on the frame rails will also enable multiple users to train on the same boxing target; thus, ensuring various people are capable of training simultaneously. This innovative, top quality product provides a versatile, authentic, method for boxing and other fighting training including mixed martial arts and kick boxing.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. A boxing apparatus comprising:

a boxing dummy with a head and shoulders and a speaker in the head and a left hand paddle and a right hand paddle each attached to the shoulders via a spring concentric to a rod with a variable penetration into the spring;

an attribute box configured to measure a player boxer attribute including a hand speed, a hand strength and a handedness and configured to electronically store, match and retrieve the hand speed, the hand strength and handedness; and a stepper motor in a mechanical connection with the rod and in an electrical connection with the attribute box and configured to cause the variable penetration based on the player boxer attribute.

2. The boxing apparatus of claim 1, wherein the hand strength is proportional to the variable penetration to stiffen the spring with more penetration and indicate more hand strength with more penetration.

3. The boxing apparatus of claim 1, wherein the hand speed is measured and stored for a match by the attribute box as a time between a hit and a subsequent hit to the hand paddles by the player boxer.

4. The boxing apparatus of claim 1, wherein the attribute box stores a handedness as left or right, measured by the player boxer favoring the right hand paddle or the left hand paddle based on a prior match or a calibration match boxer versus game.

5. The boxing apparatus of claim 1, further comprising manually storing via a data entry into the attribute box the player boxer's reach, kick, height, wingspan reach and chest, vertical jump and weight.

6. The boxing apparatus of claim 1, further comprising manually storing, via a data entry into the attribute box, a virtual boxer's reach, kick, height, wingspan reach and chest, vertical jump and weight.

7. The boxing apparatus of claim 1, wherein a match comprises the player boxer's hand strength vs. a virtual boxer's hand strength stored in the attribute box and the latter larger than the former indicated by a yell sound from the speaker.

8. The boxing apparatus of claim 1, wherein a match comprises the player boxer's hand speed vs. a virtual boxer's hand speed stored in the attribute box and the latter larger than the former indicated by a yell sound from the speaker.

9. The boxing apparatus of claim 1, wherein a match comprises the player boxer's handedness versus a virtual boxer's handedness stored in the attribute box and a mismatch giving a speed point and a strength point to a left handed boxer.

10. The boxing apparatus of claim 1, wherein a match comprises the player boxer's reach vs. a virtual boxer's reach stored in the attribute box and the latter larger than the former resulting in an extra match point to the latter.

11. The boxing apparatus of claim 1, wherein a match comprises the player boxer's height vs. a virtual boxer's height stored in the attribute box and the former larger than the latter resulting in an extra match point given to the former.

12. The boxing apparatus of claim 1, further comprising a remote control of an input and an output of the attribute box.

13. The boxing apparatus of claim 1, wherein the attribute box is located remote to the boxing dummy.

14. The boxing apparatus of claim 1, further comprising attributes of a plurality of professional boxers stored in the attribute box, each comprising a virtual boxer as an opponent for the player boxer.

15. The boxing apparatus of claim 1, wherein the player boxer matches a remote player boxer through the boxing apparatus in a wireless communication with a remote boxing apparatus.

16. The boxing apparatus of claim 15, wherein the match comprises the player boxer's hand speed vs. the remote player boxer's hand speed and the latter larger than the former indicated by a yell sound from the head speaker.

17. The boxing apparatus of claim 15, wherein the match comprises the player boxer's hand strength vs. the remote player boxer's hand strength and the former larger than the latter indicated by a yell sound from the remote head speaker.

18. The boxing apparatus of claim 1, further comprising circuits in the attribute box configured to display results of a match and to keep statistics of matches.

19. The boxing apparatus of claim 1, further comprising circuits in the attribute box configured to keep statistics of attributes of player boxers and virtual boxers.

20. The boxing apparatus of claim 1, further comprising a cell phone application and non-transient computer circuits, wherein the boxing dummy is represented by an icon on the application, and the rod and the concentric spring and the attribute box and connections there between are virtual and matches are managed by the application.

* * * * *